US008585415B2

(12) United States Patent
Marsh et al.

(10) Patent No.: US 8,585,415 B2
(45) Date of Patent: Nov. 19, 2013

(54) SHIELDING BRAID TERMINATION FOR A SHIELDED ELECTRICAL CONNECTOR

(75) Inventors: John Marsh, London (GB); Robert Baker, Middlesex (GB)
(73) Assignee: Tyco Electronics UK Ltd, Dorcan, Swindon (GB)

( * ) Notice: Subject to any disclaimer, the term of this patent is extended or adjusted under 35 U.S.C. 154(b) by 97 days.
(21) Appl. No.: 13/254,384
(22) PCT Filed: Feb. 26, 2010
(86) PCT No.: PCT/GB2010/050329
§ 371 (c)(1),
(2), (4) Date: Sep. 1, 2011
(87) PCT Pub. No.: WO2010/100467
PCT Pub. Date: Sep. 10, 2010
(65) Prior Publication Data
US 2011/0308855 A1 Dec. 22, 2011
(30) Foreign Application Priority Data
Mar. 2, 2009 (EP) ..... 09002945
(51) Int. Cl.
*H01R 4/66* (2006.01)
(52) U.S. Cl.
USPC ..... 439/98
(58) Field of Classification Search
USPC ..... 439/98, 99, 607.44, 607.41, 607.42, 439/607.5, 607.52, 607.53, 607.55, 578, 439/583, 584, 585, 588, 589, 471, 472, 882, 439/142, 143, 145, 273, 275, 319, 910, 488, 439/489, 490; 174/78
See application file for complete search history.

(56) References Cited

U.S. PATENT DOCUMENTS

| | | | | |
|---|---|---|---|---|
| 3,091,750 | A * | 5/1963 | Long et al. | 439/321 |
| 3,538,239 | A | 11/1970 | Renshaw, Jr. | |
| 4,307,926 | A * | 12/1981 | Smith | 439/607.52 |
| 6,019,615 | A | 2/2000 | Masuda | |
| 6,042,396 | A * | 3/2000 | Endo et al. | 439/98 |
| 6,280,208 | B1 * | 8/2001 | Masuda et al. | 439/559 |
| 2001/0027040 | A1 * | 10/2001 | Yoshioka et al. | 439/98 |
| 2002/0132503 | A1 | 9/2002 | Murofushi et al. | |

FOREIGN PATENT DOCUMENTS

| | | |
|---|---|---|
| EP | 1115180 A2 | 7/2001 |

OTHER PUBLICATIONS

International Search Report and Written Opinion issued by the European Patent Office, dated May 28, 2010, for PCT/GB2010/050329; 15 pages.
Search Report issued by the European Patent Office, dated Jul. 7, 2009, for Priority Application No. EP09002945.5; 7 pages.
International Preliminary Report on Patentability, dated Sep. 6, 2011, issued by the International Bureau of WIPO, Geneva, Switzerland, for related International Application No. PCT/GB2010/050329; 8 pages.

* cited by examiner

*Primary Examiner* — Tho D Ta
*Assistant Examiner* — Harshad Patel
(74) *Attorney, Agent, or Firm* — Faegre Baker Daniels LLP

(57) ABSTRACT

The present invention relates to shielded electrical cables and shielded electrical connectors to be affixed thereto, and in particular to the termination of the shielding braid provided at the electrical cable. According to the present invention, a shielding termination structure for engaging a shielding (104) of a shielded cable (100) having an insulated conductor (102) that is encompassed by said shielding is provided, said shielding termination structure (110) comprising: an electrically conductive shield body (114) for establishing an electrical connection between said shielding (104) and an electrically conductive interface (118), fixing means (126) for securing said shield body (114) at the interface (118); an electrically conductive spring element (120) that is arranged between said shield body (114) and the interface (118) for establishing the electric contact in a compressed state of the spring element (120).

15 Claims, 5 Drawing Sheets

SHIELDING BRAID TERMINATION FOR A SHIELDED ELECTRICAL CONNECTOR

BACKGROUND OF THE DISCLOSURE

The present invention relates to shielded electrical cables and shielded electrical connectors to be affixed thereto, and in particular to the termination of the shielding braid provided at the electrical cable. More specifically, the present invention can be applied for sealed electrical connections which are for instance necessary with automotive applications.

When terminating a shielded electrical cable, it is common to electrically couple the shielding braid of the cable to a shield member of an electrical connector or electrical device. One way of accomplishing this is to attach the braid directly to the shield by welding or soldering. Another method is to include a crimp ring that fits above the braid of the cable and may be crimped thereto such that the braid is positively retained. After crimping, the crimp ring must be connected with the connector shield. Radially expanding resilient elements may be used to establish the connection between the crimp ring and the housing. Another known solution is to crimp the braid directly to the connector housing. This may be accomplished by providing a flange that extends from the shield that would fit beneath the braid and provide a crimp ring thereover, that when crimped tightly fastens the braid therebetween. It is also known to join the braid to a shield flange directly as described above, but rather than using a crimp ring, a second ring is used that is press fit thereupon, thereby captivating the braid between the two rings.

However, most known solutions suffer from the disadvantage that they are not sufficiently robust to withstand the vibrations and temperature changes in the automotive application field. Moreover, in many cases the connection between the shielded electrical cable and the shield of for instance, a housing has a too high electrical resistance. On the other hand, soldering connections are making the assembly much more difficult and expensive.

SUMMARY OF THE DISCLOSURE

The object underlying the present invention therefore can be seen in providing a shielding termination structure having a low electrical resistance which can be mounted in a particularly easy way and allows the connection of the shielding of the cable to a grounded interface even under extreme ambient conditions. This object is solved by the subject matter of claim 1. Advantageous embodiments are the subject matter of the dependent claims.

According to the present invention, a shielding termination structure for engaging a shielding of a shielded cable having an insulated conductor that is encompassed by said shielding is provided. The shielding termination structure comprises an electrically conductive shield body for establishing an electrical connection between said shielding and an electrically conductive interface. Fixing means are provided for securing said shield body at the interface. According to the present invention, an electrically conductive spring element is arranged between said shield body and the interface for establishing the electrical contact in a compressed state of the spring element.

This solution has the advantage, that the shield body can be designed to have a low bulk resistance through using a high conductivity material and by having thicker sections than normally associated with stamped ferrules. The spring element provides a high normal force low resistance connection.

The achieved normal forces can amount up to 100 N. Furthermore, the spring element will absorb assembly tolerances thereby eliminating the need for tight manufacturing tolerances and thus reducing the fabrication costs. Furthermore, the spring element will ensure high pressure contact that is maintained even under conditions of vibration, differential movement due to thermal expansion or loads due to applied cable strain.

According to the present invention, the shield element can be fabricated as a machined part, therefore it is easy to manufacture from a conductive material that is electro-chemically matched to a particular interface and spring element, thereby minimizing galvanic corrosion potential, which would be especially advantageous if the sealing failed, or the application was not sealed by design.

According to the present invention, the spring element is compressed in a direction along the cable axis. Such spring elements which possess an axial resilience can be helical springs, compressible elastic materials or wave spring washers. An important idea of the present invention is that the electrical contact between the interface and the shield body is established via the spring element. The spring element therefore has to provide a high electrical conductivity either by being fabricated from a metal or a metal filled plastic material.

A particularly space saving and economic way of fabricating the spring element, however, is to use a wave spring washer.

Wave spring washers can be made from prime quality spring steel, stainless steel, copper and other materials which are readily available in standard sizes. Wave washers are wavy metal washers designed to offer a compensating spring force and maintain a load or take up shock. They are formed by a disc of irregular shape which when loaded deflects, and acts like a spring, thereby providing a pre-load between two surfaces.

The number of waves around the circumference can be two, three or even more. The spring rate is proportional to the number of waves raised to the fourth power. Wave washers are generally preferred as a cushion spacer between parts on shafts or to take up probable deviations in assembled parts. For the present invention a significant advantage can be seen in the fact that in the compressed state a wave spring washer allows high normal forces resulting in a low resistance contact, because from an electrical connector theory point of view the actual contact area is solely governed by the normal force and relative hardness of the contacting materials which results in true contact via relatively small micro-asperities, not the apparent projected area.

According to an advantageous embodiment of the present invention, the shield body is formed as an essentially tube shaped sleeve having retaining means for securing said spring element at the shield body. Thereby, it can be guaranteed that the shield body and the spring element can be preassembled as a shielding termination structure and be held on stock without the danger of losing the spring element. In the case of a wave spring washer, a particularly effective way of retaining same at the shield body is to provide a circumferential groove which accommodates the spring element.

In order to allow a facilitated assembly of the spring element at the shield body, a chamfered region can be provided at a front face of the shield body. For the assembly, the spring element is then slipped over the chamfered region and accommodated within the retaining means. The spring element preferably also has a slit in order to be opened radially for assembly.

According to a further advantageous embodiment of the present invention, the shield body has a shielding connection region which is formed as a bushing that can be encompassed by the cable shielding. In particular, when the cable shielding is formed by a braid, this allows a low resistance connection by loosening the braid only far enough to allow a tight fit around said bushing.

According to a further advantageous embodiment, the shielding termination structure further comprises a fastening ferrule for fixing the shielding onto the connection region of the shield body. Such a design allows a very secure fixing even under rough ambient conditions. The fastening ferrule can either be provided as a separate part or can be formed integrally with the rest of the shield body. The embodiment, where the fastening ferrule is fabricated as one part with the shield body offers several advantages. Firstly, the assembly process is facilitated because no separate fastening ferrule parts have to be handled. Furthermore, such a one part structure reduces the electrical resistance between the shielding braid and the shield body. Existing designs crimp the cable shield between an inner and outer ferrule, in the integrated design option, the inventive shield body integrates these two components.

In order to ensure that the cable shield is correctly located, in the integrated design option the shield body may include an inspection hole for monitoring the position of the cable shield.

The mechanical and electrical connection between the cable shield and the connection region of the shield body can be achieved by crimping, welding or soldering the fastening ferrule onto the connection region. Other known techniques for fixing a fastening ferrule around the shielding braid are of course also usable.

In order to provide a strain relief, an axial dimension of the fastening ferrule may be chosen to be longer than the connection region so that the fastening ferrule can be brought into direct contact with the cable. In particular, the ferrule can have a length that allows a crimping onto the cable jacket.

According to a preferred embodiment of the present invention, the shield body comprises a circumferential collar which is formed in a way that by fixing the shield body at the interface, a contact surface of the collar is brought into a circumferential large area contact with the interface via the compress spring element. Such a collar allows that the electrical contact is directly formed when attaching the cable to the interface.

A particularly easy way of producing a shield body with a low electrical resistance is to fabricate the shield body as a turned, cast or moulded part either from a metal, such as aluminum, or from a conductive plastic material.

As already mentioned, the shielding termination structure according to the present invention is particularly suitable for applications where a sealed electrical connection has to be provided. Consequently according to a preferred embodiment, at least one sealing is provided for protecting the electrical connection between the shield body and the interface against ingress of dust or water.

In order to fix the cable in a particularly easy and secure, albeit detachable manner to the interface, said fixing means comprises at least one screw coupling. If the screw axis is along the axis of the cable and therefore along the axis in which the compression forces are exerted by the spring element, very effective force transmission can be achieved.

BRIEF DESCRIPTION OF THE DRAWINGS

For better understanding of the present invention, same will be explained in the following based on the embodiments shown in the figures. Corresponding parts are given corresponding reference numerals and terms. Furthermore, those features or combinations of features, which show or describe different embodiments, may form separate inventive solutions in themselves. The invention will now be described by way of example with reference to the drawings, wherein.

Figures 1, 2:
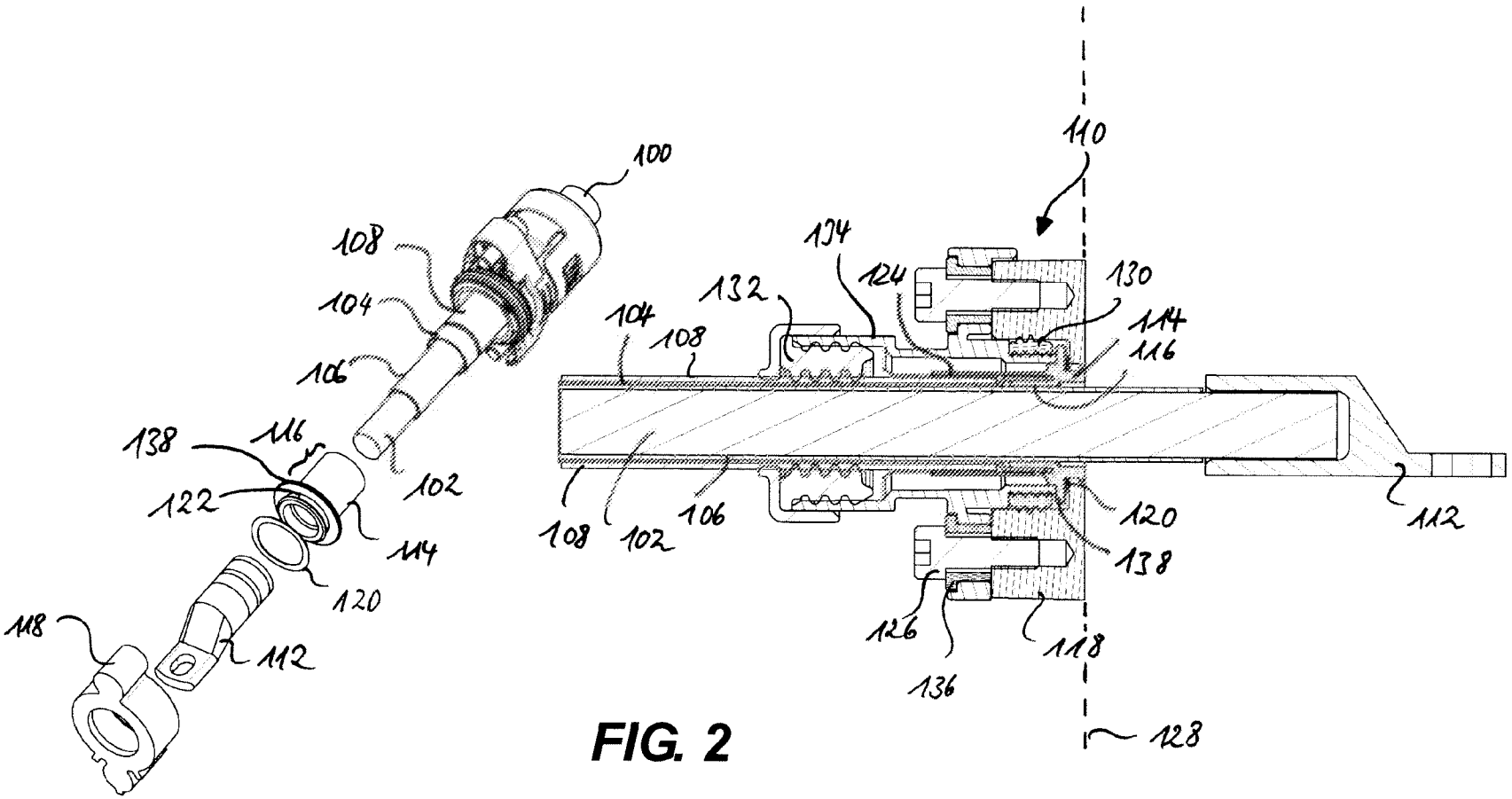
FIG. 1 is a partly exploded perspective view of a field connector for a shielded electrical cable using the inventor shielding termination structure.
FIG. 2 is a longitudinal cut of the completely assembled connector according to the embodiment of FIG. 1.

The partly exploded view of FIG. 1 shows a connector for a shielded cable 100 according to a first embodiment of the present invention. The shielded cable 100 comprises a center conductor 102 which is separated from a surrounding shielding braid 104 by means of an insulating layer 106. A cable jacket 108 which insulates the shielded cable 100 is removed to expose the shielding braid for being contacted by the inventive shielding termination structure 110.

DETAILED DESCRIPTION OF THE DRAWINGS

The center conductor is electrically contacted by means of a terminal 112. However, the particular shape of this terminal 112 is irrelevant for the inventive shielding termination structure.

According to the present invention, a shield body 114 is provided which is for instance, formed as a turned part from aluminum. In a connection region 116 this shield body 114 can be brought into contact with the shielding braid 104 for connecting the shield body 114 to an interface 118, which is shown in FIG. 1 as a separate part, but in fact in most cases will be integrally formed with a housing of an electronic component. The inventive shielding termination structure further comprises a wave spring washer 120. The wave spring washer 120 is accommodated within a groove 122 that retains the wave spring washer 120 in a preassembled state when a connection to the interface 118 is not yet established.

As becomes more apparent from FIG. 2, according to the first embodiment of the present invention, the shield body 114 is formed in a way that it integrally comprises a connection region 116 that can be encompassed by the cable shielding 104 and an integrated fastening ferrule 124 which fixes the shielding braid 104 to the connection region 116. The fastening ferrule 124 here is dimensioned in a way that it is longer than the connection region 116 and therefore can be brought into direct contact with the cable jacket 108. According to the present invention, the spring element 120 is compressed in an axial direction when the shielding termination structure 110 is attached to the interface 118. In order to exert the necessary mechanical pressure, screw couplings 126 are provided between the shielding termination structure and the interface 118. In the compressed state, the wave spring washer 120 establishes a low impedance electrical contact between the shield body 114 and the interface 118 via contact points made on crests of the wave form.

In the present arrangement, the interface 118 also defines a boundary 128 between the wet and dry regions. In FIG. 2, the left hand side region belongs to the possibly dust and water containing ambience, whereas the right hand side is associated with the dust free and dry inner region of an electronic component.

In order to protect the electrical connection between the shield body 114 and the interface 118 against ingress of dust or water, sealings are provided. The first sealing 130 is arranged on a housing 134 that accommodates the shield body 114 and directly seals against the interface 118. A second seal 132 is provided for sealing the connection of the housing 134 and the cable jacket 108. The second sealing is held in place by means of a cap nut as this is known in the art.

Finally, the screw coupling 126 is provided with a compression bush 136.

The connection between the shielding braid 104 and the connection region 116 is established by crimping the integrally formed fastening ferrule 124 onto the connection region 116. An opening in the fastening ferrule 124 serves as an inspection hole and allows an optical control whether the shielding braid is positioned correctly.

It is clear for a person skilled in the art that other techniques for fixing the fastening ferrule to the braid 104 may also be employed without departing from the idea of the present invention, such as soldering, welding or pressing lances which are provided on the fastening ferrule into the shielding braid 104.

Figure 4:
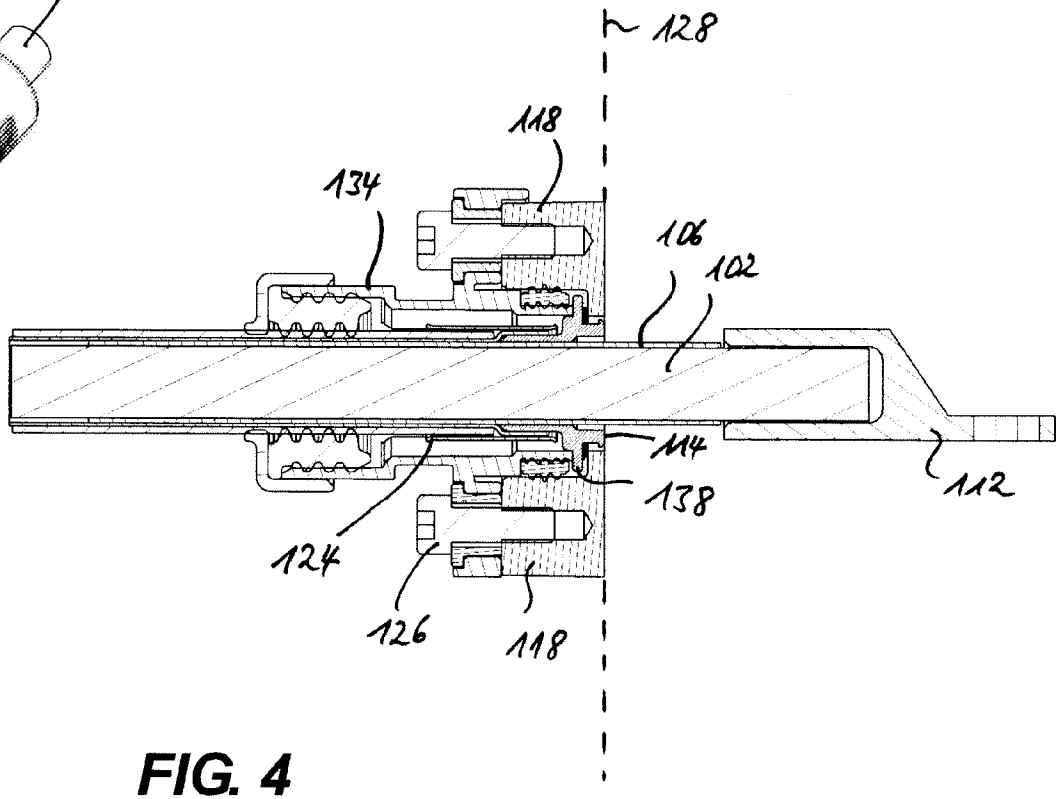
FIG. 4 is a longitudinal cut through the fully assembled connector according to the embodiment of FIG. 3.
Figure 3:
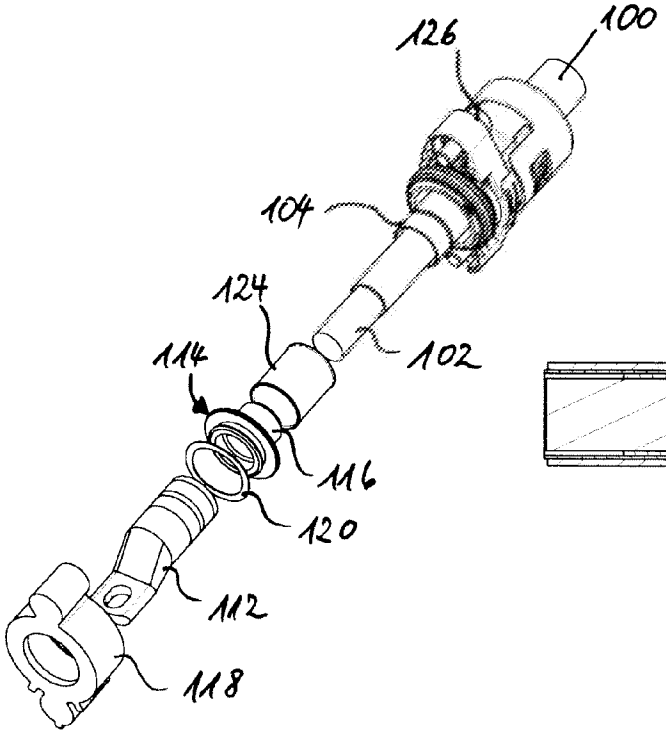
FIG. 3 is a perspective, partly exploded view of a sealed electrical connector for a shielded electrical cable according to a second embodiment.

A second embodiment of the present invention will be explained with reference to FIGS. 3 and 4. According to this embodiment, the fastening ferrule 124 is provided as a separate metal bushing. This embodiment has the advantage that for the connection region 116 and the ferrule 124 different materials can be chosen. The connection region 116 and the complete shield body 140 are made from a material that has a particularly good electrical conductivity. The fastening ferrule 124, on the other hand, may be formed from a metal that can be fixed to the shielding braid in an optimized way by crimping, soldering or welding. Also when using lances that are bent inward towards the shielding braid 104, the separate structure of the fastening ferrule is advantageous.

According to an advantageous embodiment of the present invention, the shield body 114 has a circumferential collar 138, which in the mounted stage is pressed against the interface 118, thereby compressing the wave spring washer 120 in an axial direction and establishing an electrical contract between the shield body 114 and the interface 118.

Figure 6:
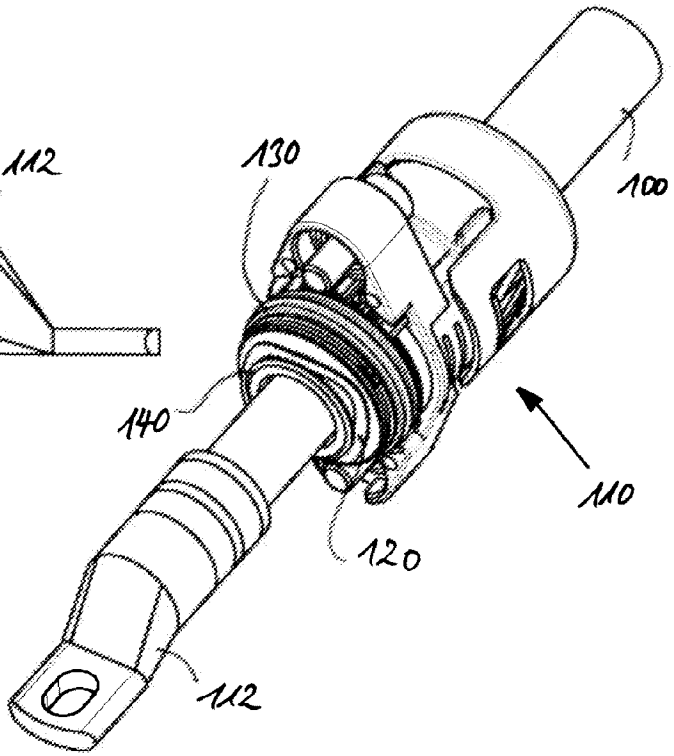
FIG. 6 is a perspective view on the connector arrangement of FIG. 5.
Figure 5:
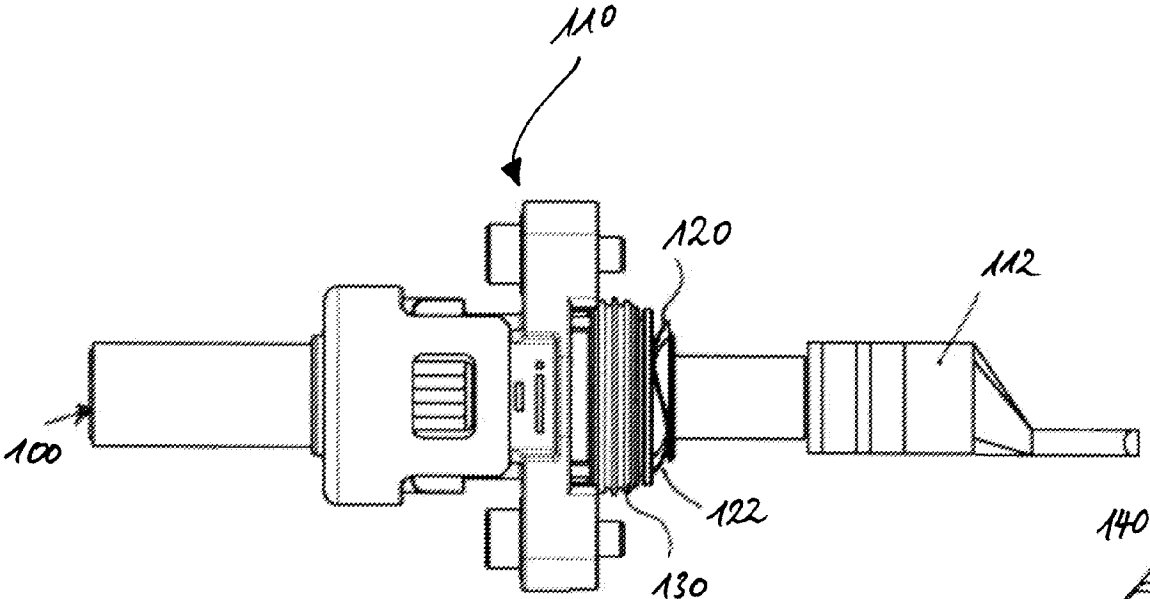
FIG. 5 is a side view of the inventive electrical connector in a preassembled state before mounting same onto an interface.

FIGS. 5 and 6 show the shielding termination structure 110 according to the present invention when mounted on a cable end before being connected to the interface. It is particularly advantageous that the shield body 114 has a groove 122 for retaining the wave spring 120 and thereby preventing a loss of the wave spring washer 120. A chamfered region 140 which is provided at the front face of the shield body 114 facilitates the assembly of the wave spring washer 120. Of course, the wave spring washer 120 can also have a slit that allows a radial extension when slipping the wave spring washer 120 into the groove 122.

Figure 7:
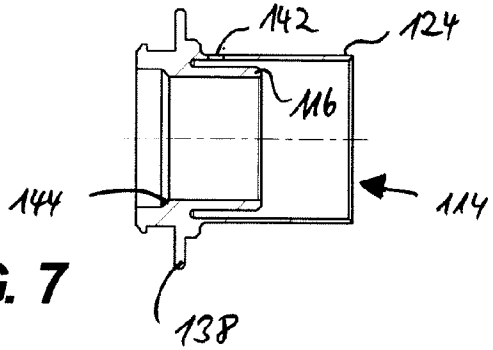
FIG. 7 is a cut perspective of a shield body according to a first embodiment as shown in FIG. 1.
Figure 8:
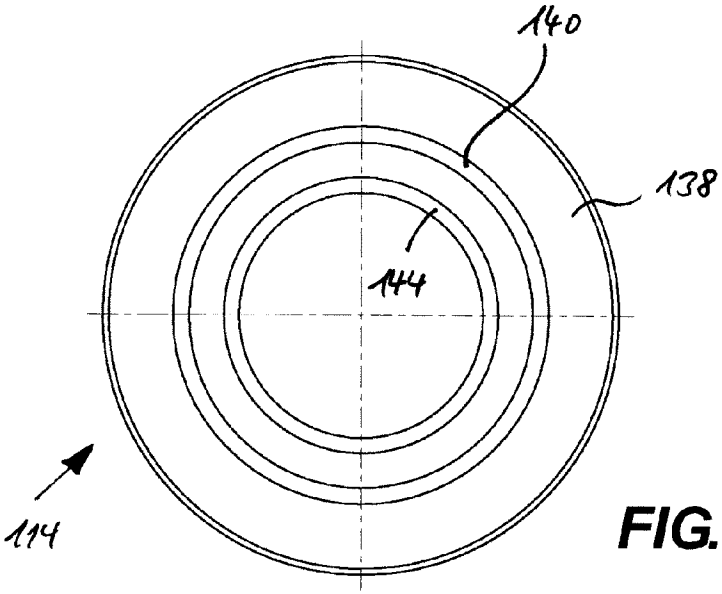
FIG. 8 is a top view onto the shield body of FIG. 7.
Figure 9:
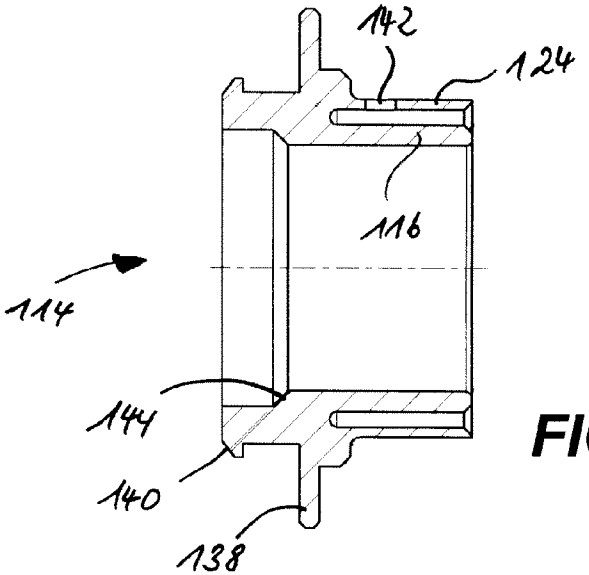
FIG. 9 is a cut perspective of a variant of the embodiment of FIG. 7.

FIGS. 7 to 9 show two variants of the shield body 114 according to the first embodiment having an integrally formed fastening ferrule. These two variants differ by the geometric dimensions of the fastening ferrule 124. In FIG. 7 the fastening ferrule 124 has a length which is longer than the connection region 116, thereby allowing a direct fixing of the fastening ferrule also onto the cable jacket and thereby providing a strain relief. An inspection hole 142 allows the visual control whether the shielding braid is mounted correctly before applying the crimping forces to the fastening ferrule 124.

In FIG. 9 the fastening ferrule 124 and the connection region 116 are formed to be flush with each other. This variant is particularly advantageous when the available space is small.

Figure 11:
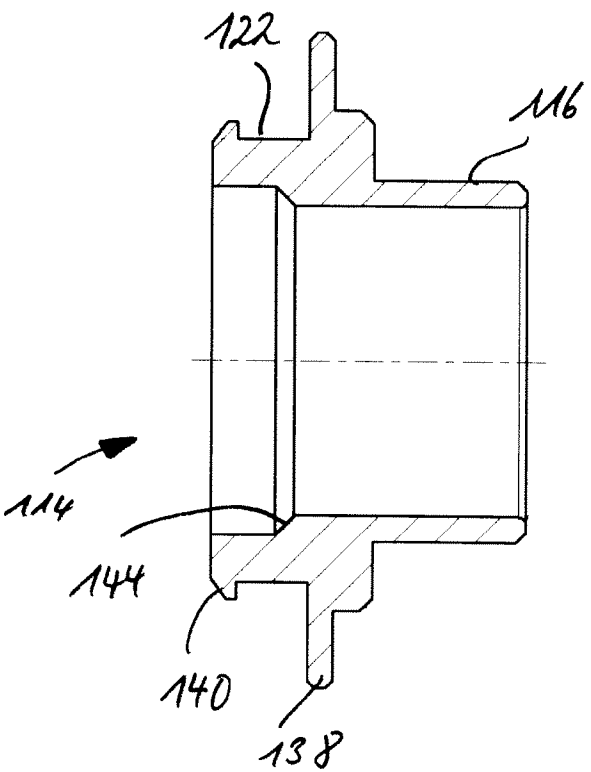
FIG. 11 is a cut perspective of the shield body of FIG. 10.
Figure 10:
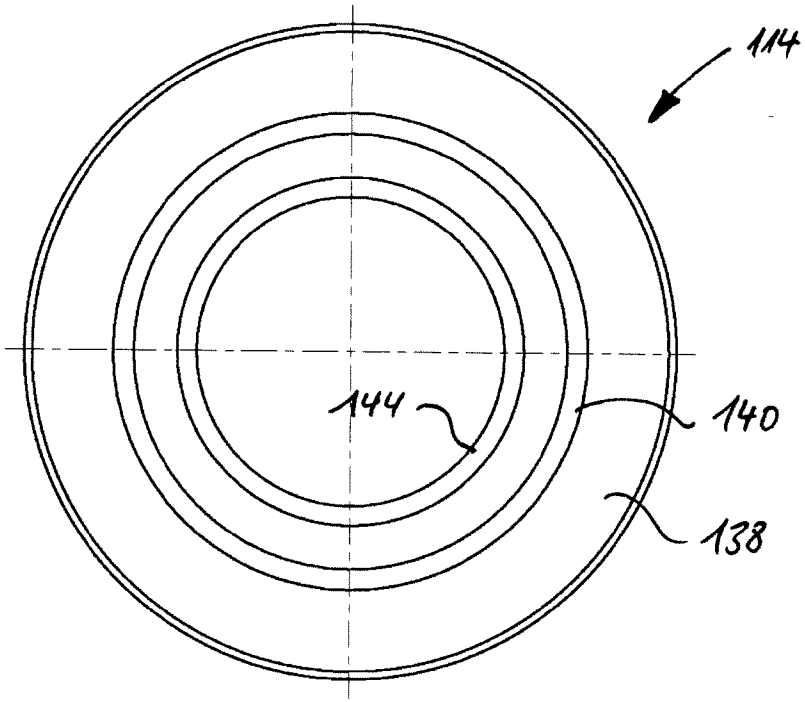
FIG. 10 is a front view of the shield body according to a second embodiment as shown in FIG. 3.

FIGS. 10 and 11 illustrate the shield body 114 according to the second embodiment which uses a separate bushing as the fastening ferrule 124. This embodiment amongst other advantages allows a particularly simple structure of the shield body 114. Toward the cable end which is connected to the terminal 112, the shield body 114 comprises a tapered region 144 which allows bending movements of the cable without damaging the insulating layer 106 when mounting the terminal to the electronic component (not shown in the FIGS).

The present invention provides a low resistance electrical connection between a cable shield and a connector interface which may in particular be of importance for high voltage connectors in the automotive application field. Two design variants are provided. The problem of connecting to the cable shield is solved by either crimping the cable shield into a recess within the shield body on the integrated option or, on the separate option, between a separate shield body and a ferrule. The problem of connecting the shield body to the interface of an electronic component is solved by the use of a wave spring washer. Thus, a high pressure contact can be maintained under conditions of vibration, differential movement due to thermal expansion or loads due to applied cable strain. Moreover, the wave spring will absorb assembly tolerances eliminating the need for tight manufacturing tolerances. Generally, the present invention may be used for any application where a connection to a cable shield is required.

| Reference Numeral | Description |
|---|---|
| 100 | Shielded cable |
| 102 | Center conductor |
| 104 | Shielding braid |
| 106 | Insulating layer |
| 108 | Cable jacket |
| 110 | Shielding termination structure |
| 112 | Terminal for the center conductor |
| 114 | Shield body |
| 116 | Connection region |
| 118 | Interface |
| 120 | Wave spring washer |
| 122 | Groove for retaining wave spring washer |
| 124 | Fastening ferrule |
| 126 | Screw coupling |
| 127 | Boundary between wet and dry ambience |
| 130 | First sealing |
| 132 | Second sealing |
| 134 | Housing |
| 136 | Compression bush |
| 138 | Collar |
| 140 | Chamfered region |
| 142 | Inspection hole |
| 144 | Tapered region |

What is claimed is:

1. Shielding termination structure for engaging a shielding of a shielded cable having an insulated conductor that is encompassed by said shielding, said shielding termination structure comprising:

an electrically conductive shield body for establishing an electrical connection between said shielding and an electrically conductive interface, the shield body including a collar and a connection region, and a portion of the shielding extending over the connection region;

fixing means for securing said shield body at the interface; and an electrically conductive spring element that is arranged between said shield body and the interface for establishing the electric contact in a compressed state of the spring element, wherein the collar is brought into a circumferential large-area contact with the interface via the compressed spring element; and wherein the shield body is formed as an essentially tube-shaped sleeve having retaining means for securing said spring element at the shield body.

2. Shielding termination structure according to claim 1, wherein said spring element comprises a wave spring washer.

3. Shielding termination structure according to claim 1, wherein at least one sealing is provided for protecting the electrical connection between said shield body and the interface against ingress of dust or water.

4. Shielding termination structure according to claim 1, wherein said fixing means comprises at least one screw coupling.

5. Shielding termination structure according to claim 1, wherein the spring element is intermediate the collar and an axial end of the shield body, the axial end facing the interface.

6. Shielding termination structure according to claim 1, wherein said retaining means is formed by a circumferential groove for accommodating said spring element.

7. Shielding termination structure according to claim 6, wherein a chamfered region is provided at a front face of the shield body for facilitating the assembly of said spring element.

8. Shielding termination structure according to claim 1, wherein the connection region is formed as a bushing and is configured to be encompassed by the cable shielding.

9. Shielding termination structure according to claim 8, further comprising a fastening ferrule for fixing the shielding on the connection region of the shield body.

10. Shielding termination structure according to claim 9, wherein the shielding is fixed on the connection region of the shield body by means of a crimping, welding or soldering connection between the fastening ferrule and the connection region of the shield body.

11. Shielding termination structure according to claim 9, wherein an axial dimension of said fastening ferrule is chosen to be longer than the connection region, so that said fastening ferrule can be brought into direct contact with the cable.

12. Shielding termination structure according to claim 9, wherein said fastening ferrule is integrally formed with the shield body.

13. Shielding termination structure according to claim 12, wherein said fastening ferrule comprises at least one inspection hole for visual confirmation of a correct position of the shielding.

14. Shielding termination structure according to claim 1, wherein the shield body is fabricated as a turned, cast or molded part.

15. Shielding termination structure according to claim 14, wherein the shield body is fabricated from an aluminum material.

* * * * *